United States Patent [19]

Schmidt

[11] 4,370,923

[45] Feb. 1, 1983

[54] APPARATUS FOR LEVELING THE SURFACE OF A STRIP OF PAPER

[75] Inventor: Sylvia Schmidt, Reutlingen, Fed. Rep. of Germany

[73] Assignee: Kleinewefers GmbH, Krefeld, Fed. Rep. of Germany

[21] Appl. No.: 233,063

[22] Filed: Feb. 10, 1981

Related U.S. Application Data

[63] Continuation of Ser. No. 44,169, May 31, 1979, abandoned.

[30] Foreign Application Priority Data

May 31, 1978 [DE] Fed. Rep. of Germany ..... 2823738

[51] Int. Cl.[3] ..... B30B 3/04; B30B 15/26; B30B 15/34

[52] U.S. Cl. ..... 100/47; 100/74; 100/93 RP; 100/170; 162/253; 162/263

[58] Field of Search ..... 162/263, DIG. 10, 198, 162/252, 205, 206, 253, 358, 361, 290, 305, 359, 360; 100/47, 48, 161, 50, 170, 74, 93 RP; 73/344, 351, 159; 364/471

[56] References Cited

U.S. PATENT DOCUMENTS

| | | | |
|---|---|---|---|
| 2,077,475 | 4/1937 | Hamersley | 100/74 |
| 2,312,310 | 3/1943 | Bradner et al. | 100/47 |
| 3,177,799 | 4/1965 | Justus et al. | 100/161 |
| 3,777,656 | 12/1973 | Müller | 100/47 |
| 3,841,963 | 10/1974 | Schlunke | 100/161 |
| 4,114,528 | 9/1978 | Walker | 162/DIG. 10 |

*Primary Examiner*—Steve Alvo

*Attorney, Agent, or Firm*—Wigman & Cohen

[57] ABSTRACT

The invention relates to an apparatus for leveling the surface of a strip of paper. The apparatus has at least two rollers forming a roller pair, which can be pressed against the strip of paper guided between them with an adjustable force by means of a load device. At least one roller may have a surface which can be influenced by means of a temperature device.

10 Claims, 2 Drawing Figures

SMOOTHNESS MEASURING AFTER LEVELING
SMOOTHNESS MEASURING BEFORE LEVELING
MOISTURE SENSOR
COMPUTER
SET POINT VALVE INDICATOR
MOISTURIZER
21
21'
22
22'
23
24
25
18
19
20
20'
17
17'
2
16
11
12
13
14
14'
15

APPARATUS FOR LEVELING THE SURFACE OF A STRIP OF PAPER

This is a continuation of application Ser. No. 44,169, filed May 31, 1979, now abandoned.

BACKGROUND OF THE INVENTION

1. Field of the Invention

The leveling of the surface of a paper strip, performed by means of a calendar, a smoothing machine, or a roller press can serve various purposes, such as the establishment of a certain thickness of the paper strip, compensation of thickness fluctuations to improve the winding process, or the compression of the paper strip to the point of transparency. In many cases, leveling is also important in order to increase the smoothness and the sheen of the surface of the strip, because the printability of a piece of paper depends upon the sheen and smoothness of its surface.

2. Description of the Prior Art

It is known that the pressure effective on the strip in the roller nip, the surface temperature of the rollers forming the roller nip, and the surface moisture of the strip effect the sheen and smoothness of a paper. Calendars are, therefore, as a general rule, especially equipped with a load device for adjusting the pressure effective on the strip in the roller nip, and are often also equipped with a heating and cooling device for the hard rollers or for at least some of the hard rollers. To increase the surface moisture of the paper strip, it is known to provide one or more vapor jet moisturizers on the calendar. These moisturizers can produce a film of moisture on the surface of the paper strip directly before it enters the roller nip.

In known devices for leveling the surface of a paper strip, the adjustment of the pressure and the roller nip and sometimes the roller temperature as well as the surface moisture of the strip for individual types of paper is performed by servicing personnel on the basis of their experience. If the load device, the temperature device, and the moisture device are in a regulating circuit, then the setting of the set point value is performed by the servicing personnel also on the basis of their experience. The results of the leveling process are thus dependent in both cases basically on the knowledge and care of the servicing personnel. This is unsatisfactory both because it is a source of mistakes and because of the dependency on the ability of the servicing personnel.

SUMMARY OF THE INVENTION

The basic objective of the invention is to form an apparatus for leveling the surface of a paper strip in such a manner that an incorrect adjustment of the parameters effecting the leveling process are excluded as far as possible. This objective is attained with an apparatus of the above-mentioned type according to the invention by at least one actual value indicator which determines a characteristic value for the condition of a surface of the paper strip, preferably the smoothness of the surface of the paper strip, a set point value indicator which establishes the set point value of the condition of the surface of the paper, and a computer which computes the values to be established by means of the load device and/or the temperature device while taking into consideration the set point value and the actual value.

Because the set point value can be established as a value which has been measured on a sample having the desired surface condition in the same manner as the actual value, the values determined by the computer can be kept free from subjective influences. For the adjustment of the pressure in the roller nip and/or the surface temperature of the rollers, the ability of the servicing personnel therefore no longer plays a role. But it is not only the exclusion of subjective influences that is more advantageous. With the aid of the computer, it is also possible to take functional connections between two or more parameters into consideration which influence the leveling process and to select operational points which are especially advantageous or even optimal for certain requirements. This represents a further substantial advantage. For example, with the aid of the computer, the remaining parameters can be selected such that, with minimal pressure in the roller nip, the desired surface condition of the strip, for example, the desired smoothness, can be attained.

The values determined by the computer can be set by a servicing person on the corresponding devices. In many cases which will be advantageous, one can also, however, connect the devices to be controlled to the computer, i.e., provide a closed process coupling. The servicing personnel then only retain a monitoring function.

Especially when at least one of the parameters to be controlled can change only relatively slowly, such as is the case, for example, with the surface temperature of the rollers, it can be advantageous to arrange, in addition to the actual value indicator arranged at a location where it is passed by the paper strip after the leveling process, at least one actual value indicator at another location which is passed by the paper strip before the leveling process. On the basis of the measured value of the latter actual value indicator, the necessary change of the parameter or parameters can then be begun at the proper time in that, for example, the regulating values are locked onto a corresponding disturbing value.

To the extent that both sides of the paper strip must have a certain surface condition, each side can be provided with an actual value indicator on the basis of whose measurement values the computer determines separate adjustment values for the temperature of at least two rollers, which are controllable with regard to their temperature independently of each other, and which come into contact with the paper strip with one or the other of their surfaces.

If it is desirable or necessary to be able to adjust not only the temperature in the leveling of the second strip side, but also the pressure independently of the values in leveling the first strip side, a pressure relieving device can be provided for at least one of the roller pairs. This type of pressure relieving device can consist, for example, of one or more hydraulic cylinders which exert a force, in the sense of a lifting of the rollers away from each other, on the bearings of these rollers on both mounting sides of the associated roller pair.

In a preferred exemplary embodiment, all actual value indicators are continually measuring measurement devices, in order to be able to measure the greatest possible area of the strip. If the paper is to have a certain smoothness after the leveling process, a continually operating smoothness measuring device is preferably employed as an actual value indicator. It is also desirable to measure the set point value on a sample piece by means of such a smoothness measuring device, so that mistakes which can arise because of different measuring methods are excluded.

The fact that, in calendars, the additional load for increasing the pressure in the roller nip was provided with the aid of two hydraulic or pneumatic cylinders which, as a general rule, act on one or the other of the ends of the rollers, does not make the control of the load device more difficult, because the computer can, without difficulty, determine the two values to be established. Therefore, even with a load device having a pressure zone control, i.e., a device in which the pressure in the individual zones can be controlled independently of the other zones, no difficulties result, at least when the actual value indicator transmits the actual values for the individual zones.

If the leveling apparatus also has a measuring device which measures the paper thickness, then the computer can, in calculating the variable parameters, also take into consideration the thickness of the paper strip or even the thickness profile of the strip in a thickness measurement over the entire strip width, and, thus, can determine that, after the leveling process, the desired strip thickness or the desired uniformity of the thickness profile is present. Accordingly, other characteristic values of the paper strip, such as the transparency, can also be measured and taken into consideration by the computer to achieve the desired characteristics of the paper strip in the determination of the parameters influencing the leveling process.

BRIEF DESCRIPTION OF THE DRAWINGS

The invention is described in greater detail below with the aid of the exemplary embodiment illustrated in the drawings.

DESCRIPTION OF THE PREFERRED EMBODIMENT

Figure 1:
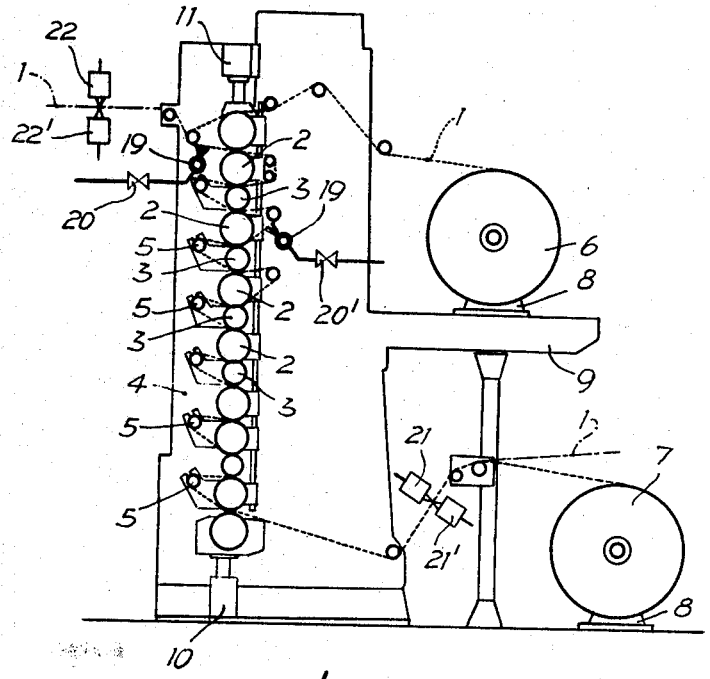
FIG. 1 shows a schematic side view of the exemplary embodiment with a calendar.

A calendar for glazing both sides of a strip of paper 1 has hard rollers 2 and elastic rollers 3, which, as FIG. 1 shows, are mounted parallel to each other, lie one above the other in a calendar frame 4, and are vertically shiftable, whereby the hard and elastic rollers 2 and 3 in both the upper and lower portions alternate with each other, so that the roller nip through which the paper strip 1 is guided, is always formed by one hard roller 2 and one elastic roller 3. In one half, one side of the paper strip 1 lies against the elastic roller 3 in each roller nip, and, in the other half, the other side of the paper strip lies against an elastic roller 3, so that the paper strip is glazed on both sides.

To the extent that guide rollers 5 or wider rollers are necessary to guide the paper strip 1, they are either arranged directly on the calendar frame 4 or in support arms which project from the mounting faces of the rollers 2 or 3, as shown in FIG. 1.

For a discontinuous method of operation, i.e., for removing the paper strip 1 from a roller 6 and winding a paper strip onto a roller 7 after glazing, roller stands 8 are provided which, as shown in FIG. 1, are arranged in the exemplary embodiment adjacent the calendar frame 4 on a platform 9 or the floor. But the calendar can also be utilized for a continuous in-line operation and can be arranged in line with a paper machine. Before entry into the calendar and after exiting the calendar, the paper strip 1 will thus have, for example, the course indicated by the broken lines in FIG. 1.

In their operational positions, the rollers 2 and 3 are held by two hydraulic cylinders 10, which act on the two mounting faces of the bottom roller. With the aid of stops against which pistons of the hydraulic cylinders 10 work, the bottom roller is held in a predetermined position. In case of a paper tear or to exchange a roller, the hydraulic cylinders 10 are made ineffective, so that all rollers 2 and 3 with the exception of the top roller, can be lowered to the degree necessary. In the lowered position, the rollers 2 and 3 are held by hanging spindles (not shown) supported from the calendar frame 4.

The weight of the rollers 2 and 3, because of their vertically shiftable mounting, produces a minimal pressure in the roller nips. This pressure can be increased with the aid of a loading device, which acts on the top roller with a downward force and, in the exemplary embodiment, consists of two hydraulic cylinders 11, which are capable of exerting small increases of downward force on the two mounting faces of the top roller. The functional dependence between smoothness and minimal pressure can be found empirically for each kind of paper. Based on this dependence, the computer calculates the values for temperature and moisture.

Figure 2:
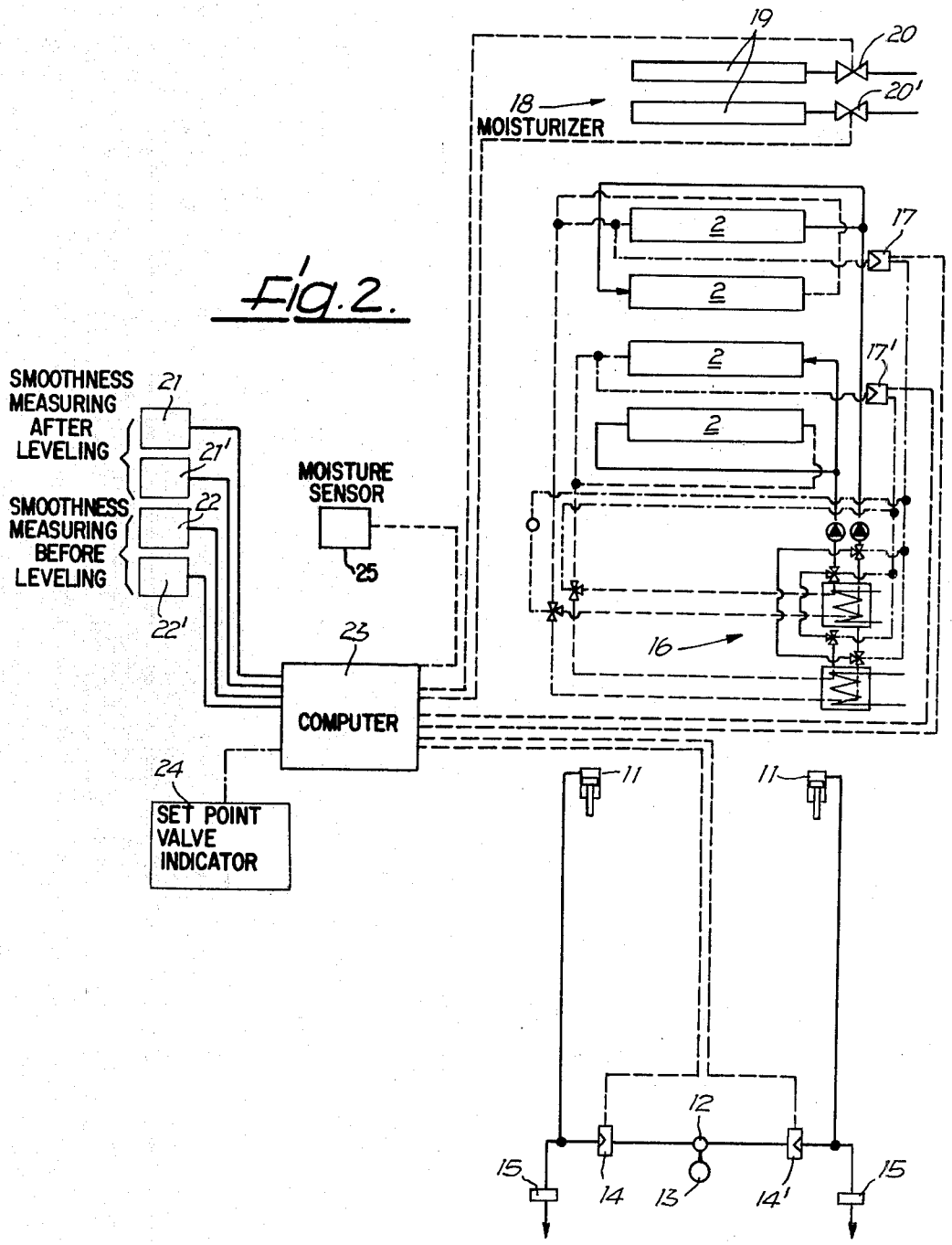
FIG. 2 shows the associated circuit diagram.

As shown in FIG. 2, a pressure regulating valve 14 or 14' lies in each of the lines leading from a pump 12, which is driven by a motor 13, to the two hydraulic cylinders 11, by means of which it is possible to control the load force of the two hydraulic cylinders 11 in nine stages independently of each other. The computer calculates the load values for the rollers from the weight of the rollers (the rollers are movable in the vertical direction) and, if necessary, the additional load acting upon the uppermost rollers or unloading values acting upon the bearings of the individual rollers. In order to be able to quickly make the hydraulic cylinders 11 ineffective, a discharge line with a valve 15 is connected to the line leading to the pump 12 between the regulating valves 14 and 14' and the hydraulic cylinder 11.

In order to be able to influence the temperature at which the glazing takes place, the heating and cooling system 16 for the hard rollers 2 is provided with two separate temperature-regulated water circulation systems. Two hard rollers 2 lying in the upper portion of the calendar beneath the top roller are connected to one circulation system and two hard rollers 2 lying above the bottom roller in the lower portion of the calendar are connected to the other circulation system. Because one side of the paper strip lies against the first-named rollers and the other side lies against the last-named rollers, the temperature during glazing of one side can be adjusted independently of the temperature of the glazing of the other side with the heating and cooling system 16. Two temperature regulators 17 and 17', which lie in the respective water circulation systems, regulate the temperature of the water flowing through the hard rollers 2 in the circulation system.

In order to be able to influence the surface moisture of the two sides of the paper strip, a moisturizing device 18 is provided which, in the exemplary embodiment, has two steam spraying pipes 19. These steam spraying pipes 19, which are connected to a steam supply line by respective regulating valves 20 and 20', are arranged in such a manner in front of the entry of the paper strip into the first roller nip or before entry of the paper strip into the fourth roller nip so that they can spray one or the other side of the paper strip with a film of moisture.

The moisture on the paper web 1 is measured by a single-sided infrared moisture sensor 25 which may be Model No. 2238 manufactured by Measurex. Based on the difference between the measured moisture and the necessary moisture, the computer 23 determines the steam quantity required.

Because in the exemplary embodiment the paper strip 1 is to have a certain roughness or smoothness on both sides after passing through the calendar, the smoothness of both sides of the paper strip is measured shortly after the paper strip passes out of the last roller nip with the aid of two smoothness measuring devices 21 and 21'. These identical smoothness measuring devices 21 and 21' operate continuously and detect the smoothness over the entire strip width by sending a beam of light to the surface of the paper web 1 and measuring scattered light, since scattering is a function of smoothness. Devices 21 and 21' are described in Pulp and Paper, Canada, Vol. 79, No. 5, May, 1978, pages 46–51. The smoothness of one or both surfaces of the paper strip 1 can also take place with identical smoothness measuring devices before entry into the calendar. This is especially advantageous when the calendar operates in line. Therefore, in FIG. 1, the two additional smoothness measuring devices 22 and 22', which may be the same as devices 21 and 21', are arranged at a location passed by the paper strip coming from a prior portion of a paper machine. Further measuring devices, such as, for example, thickness measuring devices, are not provided in the exemplary embodiment because here only a certain smoothness is to be reached, but may also be used herewith. The thickness measuring device may be the infrared thickness sensor No. 2335 of Measurex.

The two smoothness measuring devices 21 and 21' serve as actual value indicators for the smoothness of the paper strip after glazing. These measurement values are entered into a computer 23, which, for example, may be the 16 bit computer system model 2001 manufactured by Measurex. The computer 23 also receives the associated set point values from a set point value indicator 24. This indicator 24 may be a data input device, for example, the computer key board or a measuring device which measures the set point value at a sample. Thus, the set point value indicator or nominal value selector may be the same kind of device as device 21, because the set point value is given by a sample of paper. However, it is also possible to present this value by means of a keyboard or an analog input device. The nominal value may be preset and indicated by a model No. 2301 display selector of the Measurex system 2001. Advantageously, the set point values are determined at the beginning of the operation with the aid of the smoothness measuring devices 21 and 21' or identical smoothness measuring devices on a sample having the desired smoothness. The computer 23 transmits the values of the force of the two hydraulic cylinders 11 and 11', the temperature of the two water channels of the heating and cooling system 16, the steam quantity which must be sprayed onto the paper strip 1 by the two steam spray tubes 19 on the basis of the actual values, and the set point values into the program stored therein. Therefore, the two pressure regulating valves 14 and 14', the two temperature regulators 17 and 17', and the two regulating valves 20 and 20' for the steam spraying tubes 19 are connected to the output of the computer via appropriate interfaces provided therewith. The computer thus directly controls the valves connected thereto by control signals corresponding to the calculated quantity of pressure, moisture, and heat so that a closed process coupling is present. The servicing persons thus retain only a monitoring function.

If the two smoothness measuring devices 22 and 22', which measure the actual value of the smoothness of the paper strip 1 before entry into the calendar, are also connected to the computer 23, then the two measurement values of these devices 22 and 22' are locked onto the regulating values determined by the computer 23 as disturbance values which may, for instance, be disturbing voltages changing the level of a control signal. It is well known in control engineering to add a signal of a measuring device, like a disturbing signal, to the control signal. The signals from 22 and 22' represent the actual smoothness of the paper web before smoothing. These signals are added to the control signals delivered by the computer. The disturbance values or variables are values which cause fluctuations or deviations of the output quantity of the controlled system. the output quantity influences the manipulated variable by means of the automatic controller. The value measured by smoothness measuring devices 22 and 22' is added to the output of the computer 23 as a disturbance variable. Thus, the controller is provided with disturbance variable feedback.

The programs according to which the computer operates can be selected according to the desired goal or can be rigidly established. Thus, for example, a glazing can be performed with normal pressure in the roller nip or a glazing can be performed with maximum speed of the paper strip 1 through the calendar. The computer program considers the measured factors when determining the smoothness of the paper strip. The actual value of smoothness measured continuously over the whole width of the paper web is continuously compared with the nominal value of smoothness. If there is a difference, the computer calculates the setting of the valves necessary for eliminating the difference. For this calculation, the computer uses functions or dependences of smoothness, on the one hand, and temperature, pressure, and moisture, on the other hand, determined empirically for the kind of paper being levelled. The computer is a digital device. The computer does not control the speed of the paper strip. Paper speed is constant and preset, for instance, by the machine producing the strip.

Although only a preferred embodiment is specifically illustrated and described herein, it will be appreciated that many modifications and variations of the present invention are possible in light of the above teachings and within the purview of the appended claims without departing from the spirit and intended scope of the invention.

I claim:

1. Apparatus for leveling the surface of a strip of paper, said apparatus having at least two rollers forming a roller pair for pressing against the strip of paper guided between them with an adjustable force by a load device, at least one roller of said roller pair having a surface influenced by a temperature device, said apparatus comprising:

actual value indicator means for producing an actual characteristic value signal representative of the smoothness of the surface of the strip of paper;

set point value indicator means for producing a set point value signal representative of the desired smoothness of the surface of the strip of paper;

means for producing a load signal representative of the force applied by said load device to said strip of paper;

temperature controlling means for changing the surface temperature of at least one of said two rollers to change the temperature of a surface of said strip of paper, said temperature controlling means including means for producing a temperature value signal representative of the temperature of a surface of said strip of paper;

computer means connected to receive said actual characteristic value, set point value, load and temperature value signals for calculating adjustment values for said load device and said temperature controlling means and for producing output load and output temperature controlling signals representative of the calculated adjustment values; and said computer means also being connected to said load device and said temperature controlling means;

wherein said computer means transmits said output load and output temperature controlling signals to said load device and said temperature controlling means, respectively, for varying the force applied to the strip of paper and the temperature of a surface of said strip of paper in accordance with the calculated adjustment values, such that the surface of the strip of paper is leveled with a minimal amount of force applied to said strip of paper.

2. Apparatus for leveling the surface of a strip of paper, said apparatus having at least two rollers forming a roller pair for pressing against the strip of paper guided between them with an adjustable force by a load device, at least one roller of said roller pair having a surface influenced by a temperature device, said apparatus comprising:

first actual value indicator means arranged at a point where the strip of paper passes after the leveling thereof for producing a first actual characteristic value signal representative of the smoothness of the surface of the strip of paper after the leveling thereof;

second actual value indicator means arranged at a point where the strip of paper passes prior to the leveling thereof for producing a second actual characteristic value signal representative of the smoothness of the surface of the strip of paper before the leveling thereof;

set point value indicator means for producing a set point value signal representative of the desired smoothness of the strip of paper;

means for producing a load signal representative of the force applied by said load device to said strip of paper;

temperature controlling means for changing the surface temperature of at least one of said two rollers to change the temperature of a surface of said strip of paper, said temperature controlling means including means for producing a temperature value signal representative of the temperature of a surface of said strip of paper;

computer means connected to receive said first and second actual characteristic value, set point value, load and temperature value signals for calculating adjustment values for said load device and said temperature controlling means and for producing output load and output temperature controlling signals representative of the calculated values; and said computer means also being connected to said load device and said temperature controlling means;

wherein said computer means transmits said output load and output temperature controlling signals to said load device and said temperature controlling means, respectively, for varying the force applied to the strip of paper and the temperature of a surface of said strip of paper in accordance with the calculated adjustment values, such that the surface of the strip of paper is leveled with a minimal amount of force applied to said strip of paper.

3. Apparatus according to claims 1 or 2, further including:

moisture controlling means, connected to said computer means, for controlling the surface moisture of said strip of paper, said moisture controlling means including means for producing a moisture value signal representative of the surface moisture of said strip of paper;

whereby said computer means additionally receives said moisture value signal and additionally produces a moisture controlling signal which moisture controlling signal is transmitted to said moisture controlling means to vary the surface moisture of said strip of paper.

4. Apparatus according to claim 1, further comprising, in addition to the actual value indicator means, which is arranged at a point where the strip of paper passes after the leveling thereof, at least one other general value indicator means arranged at a point where the strip of paper passes prior to the leveling thereof.

5. Apparatus according to claim 4, wherein at least one actual value indicator means is provided for each side of the paper strip, on the basis of whose measured characteristic values the computer means transmits separate adjustment values for the temperature of said at least two rollers, which contact the strip of paper with one or the other of their surfaces.

6. Apparatus according to claim 5, wherein said at least two rollers are independently controllable with regard to their surface temperature and are associated with two roller pairs, of which at least one roller pair is provided with a pressure-relieving device.

7. Apparatus according to claim 6, wherein each of said actual value indicator means is a continually operating measurement device.

8. Apparatus according to claim 1, wherein the set point value indicator means includes a measuring device which measures the smoothness condition of the surface of the strip of paper.

9. Apparatus according to claim 1, wherein said load device includes means for separately adjusting the force applied to said strip of paper at two ends of said at least two rollers, and said computer means further calculates and transmits separate load signals for the two ends of said at least two rollers of said load device.

10. Apparatus according to claim 1, further comprising at least one paper thickness measuring device, whose measurement results are taken into consideration by the computer means in determining a value for one of a pressure in one of said at least two rollers, a temperature of the surface of said at least one roller, and moisture added by a moisture device for maintaining a minimal pressure in a roller nip.

* * * * *